US005607148A

United States Patent [19]

Mack et al.

[11] Patent Number: 5,607,148

[45] Date of Patent: Mar. 4, 1997

[54] DEVICE FOR REMOVING COPIES DIVERTED FROM A CONVEYED STREAM THEREOF

[76] Inventors: Richard B. Mack, Sophie-Scholl-Str. 14, D-68782 Brühl; Rainer Klenk, Franziskus-Str. 6, D-68789 St. Leon-Rot, both of Germany; Thomas Mc Krell, 428 Washington Rd., Rye, N.H. 03870

[21] Appl. No.: 584,153

[22] Filed: Jan. 10, 1996

Related U.S. Application Data

[63] Continuation of Ser. No. 243,853, May 17, 1994, abandoned.

[30] Foreign Application Priority Data

May 17, 1993 [DE] Germany ..... 43 16 400.5

[51] Int. Cl.[6] ..... B65H 39/10

[52] U.S. Cl. ..... 271/303; 271/194; 271/211; 271/183; 271/182; 271/84

[58] Field of Search ..... 271/303, 304, 271/194, 197, 182, 183, 84, 211, 309; 83/89, 74

[56] References Cited

U.S. PATENT DOCUMENTS

| | | | |
|---|---|---|---|
| 2,433,685 | 12/1947 | Dowell | 83/89 |
| 2,576,956 | 12/1951 | Matthews . | |
| 3,178,174 | 4/1965 | Schneider | 271/183 |
| 3,550,493 | 12/1970 | Benbenek | 83/94 |
| 4,317,563 | 3/1982 | Zimmerman et al. . | |
| 4,405,125 | 9/1983 | Kulpa et al. | 271/211 |
| 4,436,302 | 3/1984 | Frye et al. | 271/183 |
| 4,565,478 | 1/1986 | Ericsson | 271/194 |
| 4,667,953 | 5/1987 | Hirakawa et al. . | |
| 5,060,928 | 10/1991 | Vits | 271/194 |
| 5,133,542 | 7/1992 | Kwiatkowski et al. | 271/211 |
| 5,186,450 | 2/1993 | Vits . | |

FOREIGN PATENT DOCUMENTS

| | | | |
|---|---|---|---|
| 4020398 | 2/1992 | Germany . | |
| 1010733 | 11/1965 | United Kingdom | 271/303 |
| 1136421 | 12/1968 | United Kingdom | 271/197 |
| 1248750 | 10/1971 | United Kingdom . | |
| 1445913 | 8/1976 | United Kingdom | 271/303 |
| 1541562 | 3/1979 | United Kingdom . | |
| 2037259 | 7/1980 | United Kingdom . | |
| 2042479 | 9/1980 | United Kingdom . | |

*Primary Examiner*—H. Grant Skaggs

*Attorney, Agent, or Firm*—Herbert L. Lerner; Laurence A. Greenberg

[57] ABSTRACT

Device for removing copies diverted from a conveyed stream thereof in a rotary cross cutter or delivery in a sheet-fed rotary printing press includes a device for decelerating the copies which are transported at an incoming conveying speed, the decelerating device being disposed so as to act upon both sides of the copies which are to be decelerated, a device for defining a copy-transport plane, a copy guide forming a diverter disposed down-line from the decelerating device and above the device for defining a copy-transport plane, and respective structures defining two conveying planes disposed down-line from the copy guide, at least one of the conveying plane-defining structures including a pneumatically acted-upon conveying device.

14 Claims, 3 Drawing Sheets

DEVICE FOR REMOVING COPIES DIVERTED FROM A CONVEYED STREAM THEREOF

This application is a continuation of application Ser. No. 08/243,853, filed May 17, 1994, now abandoned.

BACKGROUND OF THE INVENTION

1. Field of the Invention

The invention relates to a device for removing copies diverted from a conveyed stream thereof in a rotary cross cutter or delivery in sheet-fed rotary printing presses, including a device for decelerating the copies which are transported at an incoming conveying speed, the decelerating device being disposed so as to act upon both sides of the copies which are to be decelerated, and a structure defining a copy-transport plane which is acted upon pneumatically being disposed up-line from the decelerating device.

The published German Patent Document DE 40 20 398 C1 discloses a device for shingling or overlapping and delivering sheets which have been cut from a web of material by a cross cutter. This heretofore known device, which is disposed up-line from a main sheet-pile region, decelerates the sheets, which are transported in a continuous stream, and delivers them to a main pile. A diverter for waste sheets was not initially provided in this basic construction.

It is accordingly an object of the invention to provide a device for removing diverted copies from a conveyed stream thereof which offers a possibility for an operator-friendly removal of inspection copies or sample copies and for separating-out waste copies.

SUMMARY OF THE INVENTION

With the foregoing and other objects in view, there is provided, in accordance with the invention, a device for removing copies diverted from a conveyed stream thereof in a rotary cross cutter or delivery in a sheet-fed rotary printing press, including a device for decelerating the copies which are transported at an incoming conveying speed, the decelerating device being disposed so as to act upon both sides of the copies which are to be decelerated, comprising means for defining a copy-transport plane, a copy guide forming a diverter disposed down-line from the decelerating device and above the means for defining a copy-transport plane, and respective means defining two conveying planes disposed down-line from the copy guide, at least one of the conveying plane-defining means including a pneumatically acted-upon conveying device.

In accordance with another feature of the invention, one of the conveying planes is disposed above the other and includes a delivery to which copies diverted from the conveyed stream are deliverable, the other of the conveying planes including a main pile to which the copies remaining in the conveyed stream are feedable.

In accordance with a further feature of the invention, one of the conveying planes is disposed above the other and includes pulling devices operatively assigned thereto.

In accordance with an added feature of the invention, one of the conveying planes is disposed above the other, and an upper copy brake is accommodated in the one conveying plane.

In accordance with an additional feature of the invention, one of the conveying planes is disposed above the other and is formed as a horizontal copy guide in a main operating region, and a removal region for diverted copies is provided adjoining the main operating region.

In accordance with yet another feature of the invention, the conveying plane of the one conveying plane-defining means is lower than the other, and the pneumatically acted-upon conveying device is disengageable from the lower conveying plane.

In accordance with yet a further feature of the invention, the device includes a carriage to which the pneumatically acted-upon conveying device is attached.

In accordance with yet an added feature of the invention, the device includes a rail whereon the carriage is movable, and an actuating cylinder operatively engaging the carriage for moving the carriage on the rail.

In accordance with yet an additional feature of the invention, the upper copy brake comprises braking cams provided with brushes.

In accordance with still another feature of the invention, the copy guide is formed of suction tapes having an entry region, and swivel cams are included for deflecting the copies in the entry region of the suction tapes.

In accordance with still a further feature of the invention, the one conveying plane disposed above the other is formed of a floating bar having conveying and braking functions, and a delivery is included adjoining the floating bar.

In accordance with still an added feature of the invention, the copy guide is formed as a swivellable floating bar.

In accordance with a concomitant feature of the invention, the device includes a controlled air nozzle disposed above the delivery for applying air blasts to the copies so as to assist in pile formation in the delivery.

The advantages attainable with the construction according to the invention are primarily in that inspection or sample copies can be conveyed into a main operating region of a cross cutter or a delivery, from which they can be removed readily by the pressmen. The use of a further pneumatic or blast or blowing air-actuated conveying device in the upper conveying plane permits a production on two piles.

The arrangement of a separate conveying plane above the main-pile region makes it considerably easier, due to good accessibility and ease of inspection, for waste copies or inspection-sheet copies to be removed, because it is no longer necessary to intervene during production into the delivery and onto the main pile. Moreover, the arrangement according to the invention is space-saving and very advantageous ergonomically. Moreover, the separation of the conveying planes in the delivery region into a conveying plane for the main pile and a further conveying plane for waste or inspection-sheet copies facilitates inclusion thereof into a central printing-press remote-operation system.

Further realization of the concepts upon which the invention is based provide, for example, that deflector devices be disposed in the upper conveying plane, thereby improving the transfer of the copies from the swivellable copy guide to the upper conveying plane. For the further braking of the copies in the upper conveying plane, a copy brake in the form of rotating cams provided with braking brushes is provided in the upper conveying plane. This is suitable, for example, in cases where production is to take place on two piles. The additional copy brake in the upper conveying plane makes it possible to achieve a greater accuracy or precision of delivery, a criterion which is of rather minor significance with regard to inspection-sheet removal or waste-copy diversion. Furthermore, the upper conveying plane, in the form of a horizontal copy guide, is adjoined in the main operating region by a removal region for diverted copies. The blast air-actuated conveying device, which is disposed above the main-pile region, may be disengaged from the lower conveying plane. This considerably improves the accessibility of the cross-cutter components during the performance of maintenance operations. Through the intermediary of an actuating cylinder, the blast air-actuated conveying device, which is attached to a carriage movable on an inclined rail, is moved away from the main-pile region.

Other features which are considered as characteristic for the invention are set forth in the appended claims.

Although the invention is illustrated and described herein as embodied in a device for removing copies diverted from a conveyed stream thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
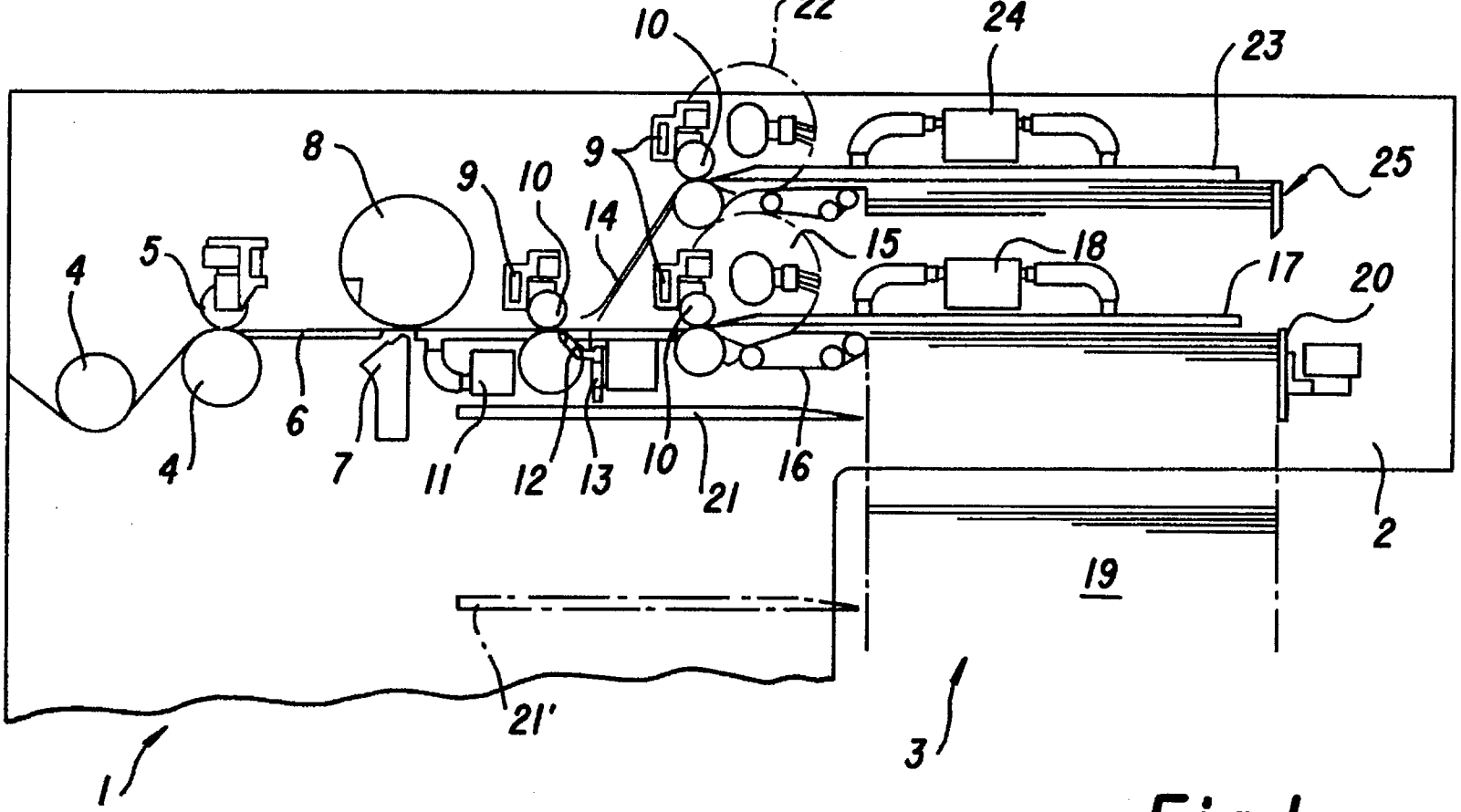
FIG. 1 is a diagrammatic side elevational view of a configuration of two conveying planes disposed above one another and having a respective copy brake and a respective conveying device acted-upon by blowing air, in accordance with the invention.

Referring now to the drawings and, first, particularly to FIG. 1 thereof, there is shown therein, in a side elevational view, a cross-cutter configuration according to the invention in which two conveying planes, situated one above the other, are positioned down-line from a diverter.

Rotatably mounted in side walls 2 of a rotary cross cutter 1 are deflector rollers 4, through the intermediary of which a web of material, which may also be formed of a plurality of web layers, is transported. Situated down-line from the deflector roller 4 are press-on or proof rollers 5, down-line from which, in turn, there extends in the horizontal direction a copy-transport plane 6 adjoined by a cutting cylinder 8 which, cooperating with a stationary bottom blade 7, causes individual copies 36 (FIG. 3) to be cut off from the web of material. The conveying plane extending down-line from the cross-cutting unit is acted-upon by blowing or blast air through the intermediary of an air supply 11, which assures a contactless conveyance of the copies 36. Press-on or proof rollers 10 are disposed above the conveying plane on a cross member or traverse 9 extending transversely with respect to the transport direction of the copies 36, for the purpose of preventing fluttering of the shingled or overlapping continuous stream of copies 36 before the copies reach the swivellable copy guide 14 (e.g. formed with suction tapes). Provided below the conveying planes, but only diagrammatically indicated in FIG. 1, are swivel cams 12 and associated actuating elements 13 which, however, are not part of the subject matter of the invention of the instant application. Behind or down-line from the diverter formed by the swivellable copy guide 14, additional press-on or proof rollers 10 are held on a further cross member or traverse 9 before the copies reach a lower copy brake 15.

By means of the rotating copy brake 15, the copies 36 are pressed against suction tapes 16 above a suction box, thereby further increasing the deceleration of the copies 36 which are to be delivered onto a main pile 19 in the pile region 3. After passing the lower copy brake 15 and the suction tapes 16 decelerating devices, the copies 36 come into the region of influence of a conveying device 17 acted-upon by blowing or blast air, which is in the form of a floating bar and includes an air-supply system 18. The copies 36 are delivered onto the main pile 19 and are laterally aligned at a stop 20. Indicated below the air supply 11, the swivel cams 12 and the actuating element 13 is an auxiliary-pile support 21, which is lowerable into a position 21' indicated by phantom lines.

In FIG. 1, fastened to a cross member 9 at the upper end of the swivellable copy guide 14 are press-on or proof rollers 10, which promote the transfer of the copies 36 exiting the swivellable copy guide 14 under a floating bar 23 provided thereat. The floating bar 23 has a separate air supply 24. An upper copy brake 22 may optionally be positioned before or up-line from the floating bar 23, which makes possible the deceleration of the copies 36 which have been diverted into the upper conveying plane. The copies, with the aid of the upper copy brake 22, can be pressed against a support which is bent in the entry region, can be decelerated in this manner and can be delivered below the floating bar 23. The copies may be removed at the location 25. If the copies are to be delivered continuously onto a second pile in the upper conveying plane below the floating bar 23, it is necessary, of course, appropriately to lengthen the swivellable copy guide 14. The upper copy brake 22, the vacuum or negative-pressure system 24 and the floating bar 23 must, in this case, be positioned at an appropriately higher location.

Figure 2:
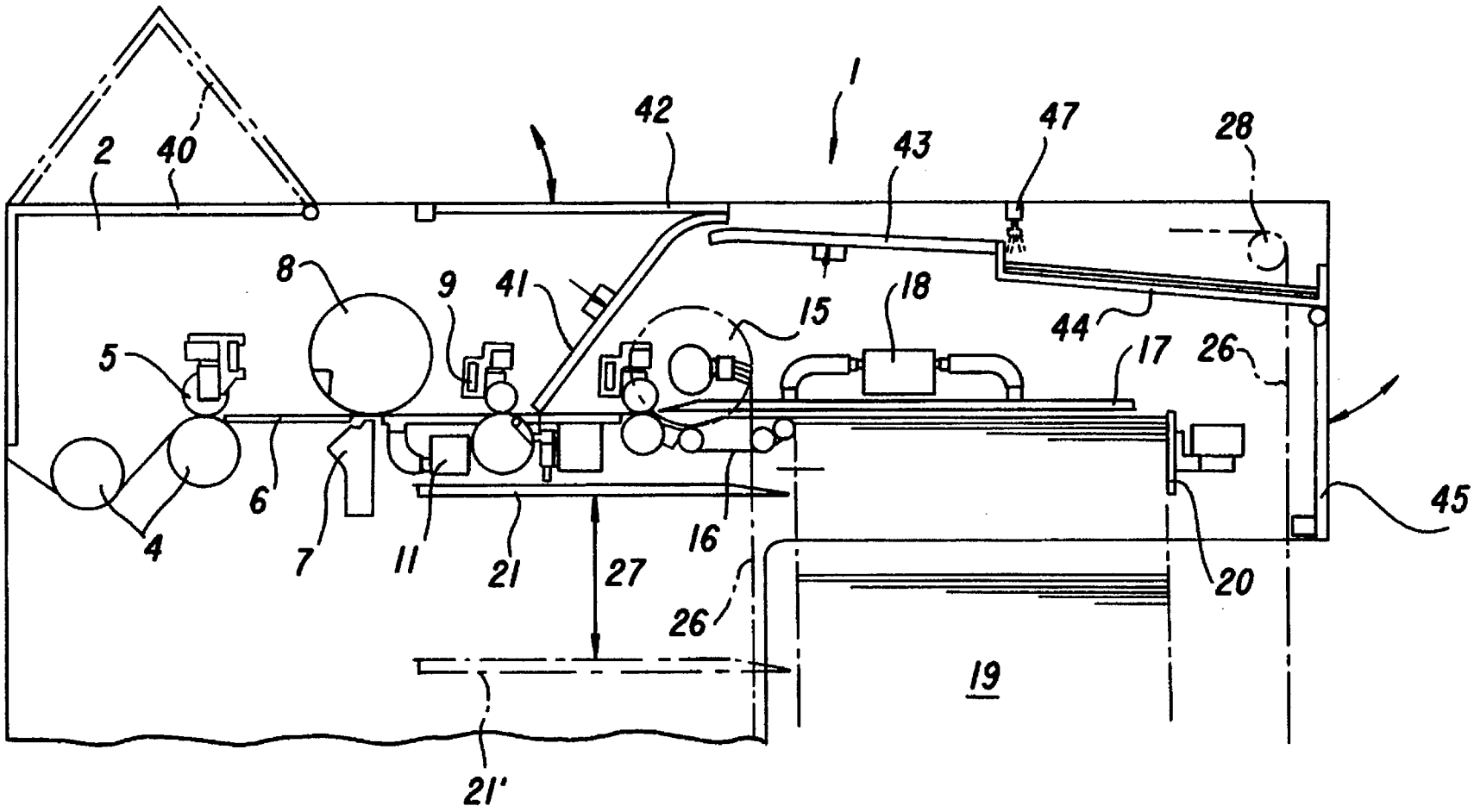
FIG. 2 is a view similar to that of FIG. 1 of another embodiment of the invention having a horizontal copy guide in the upper conveying plane.

FIG. 2 shows the configuration of a rotary cross cutter, the upper conveying plane of which is formed of individual, swivellable sections.

Instead of a swivellable copy guide 14, the embodiment of FIG. 2 has a floating bar 41 which conveys the copies, diverted by the swivel cam 12, into the upper transport plane formed by a swivellable floating bar 43 and a delivery 44. The floating bar 43, which acts simultaneously as a protective guard, is formed on its underside with a connection port for its air supply. With reference to the delivery 44 disposed down-line therefrom, the floating bar 43 is installed in a slightly inclined position. Situated above the transition from the floating bar 43 to the delivery 44 is a controlled air nozzle 47, which acts, by controlled blowing or blast-air actuation, on the waste or inspection-sheet copies which are to be stacked on the sheet pile. The air jet escaping from the air nozzle 47 is controlled in such a manner that it escapes from the air nozzle 47 whenever the trailing edge of a copy 36, leaving the floating bar 43, is located above the delivery 44, which adjoins the floating bar 43. The air jet presses the copy 36 into the delivery 44, so that the following copy 36 can be guided thereover, and no hindrance occurs. The delivery 44 has a stop at its rearward end, so that the inspection-sheet or waste copies can be collected one on top of the other. Provided above the floating bar 41 is a protective guard 42, which is movable in the direction of the curved double arrow. After the protective guard 42 has been raised, the cross-cutter components situated thereunder are accessible. Further provided is a protective guard 40, which is able to be swung or flapped into the position indicated by the phantom lines.

A protective, swivellable removal guard 45 formed, for example, of plexiglass, is disposed behind the main pile 19. The protective removal guard 45 contacts a lower stop and opens accessibility to the main pile 19.

Shown below the air supply 11 and the suction tapes 16 is an auxiliary-pile support 21 in its upper position.

When the main pile 19 is lowered and changed by means of the lifting chains 26, which are guided around the deflector wheels 28, the auxiliary-pile support 21 is inserted and takes over the copies in a conventional non-stop operating mode. While taking over the copies, the auxiliary-pile support 21 is lowered along the lowering region 27 as far as the position 21' shown in phantom. It is clear that, when inserted, the auxiliary-pile support 21 is in the region of the main pile 19, below the floating bar 17. This, however, forms no part of the subject matter of the invention of the instant application.

Figure 3:
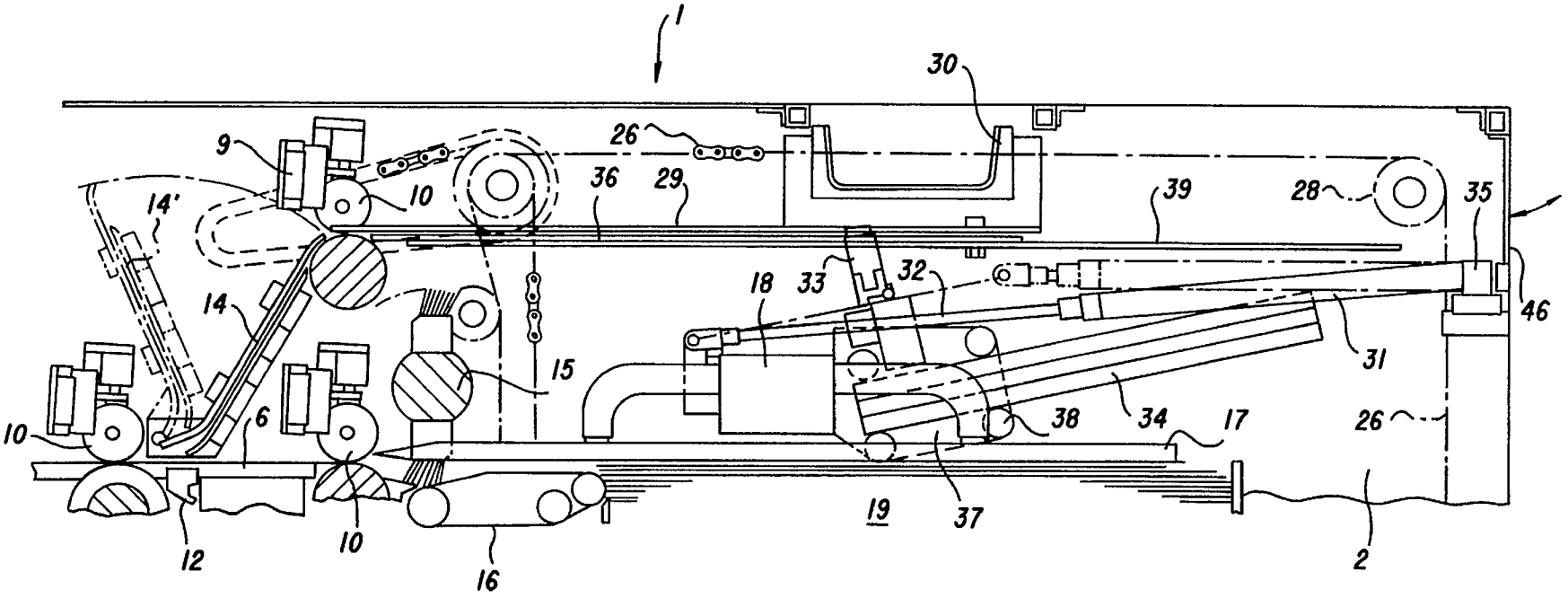
FIG. 3 is a view similar to that of FIGS. 1 and 2 of a third embodiment of the invention having a conveying device acted-upon by blowing air which is detachable or disconnectable from the lower conveying plane.

FIG. 3 shows a further embodiment of a rotary cross cutter in which the conveying device acted-upon by blowing or blast air can be disengaged or detached from the lower conveying plane.

The swivellable copy guide 14, disposed above the transport plane 6, may be swivelled down into the position indicated in phantom at 14'. The copy 36 to be diverted is introduced, by the press-on or proof rollers 10 fastened to the cross member 9, into the horizontal copy guide 29, which is adjoined by a removal region 39. Situated behind the removal region 39 is a removal protective guard 46, which is movable in the direction of the curved double arrow. The pressman is able, in a relatively simple manner, to pull out inspection copies or to remove piles of waste. Situated on an inclined guide rail 34 is a movable carriage 37, which has a plurality of guide rollers 38. Attached to the carriage 37 is the air supply 18, which actuates the floating bars 17 and causes the controlled delivery of copies onto the main pile 19. A piston rod 32, extensible out of an actuating cylinder 31, is connected to the air supply 18. The actuating cylinder 31 is fixed, through the intermediary of a counter-bearing 35, to the side wall 2 of the rotary cross cutter. When the floating bar 17 is disengaged from the main pile 19 in order, for example, to carry out maintenance operations, the front parts of the floating bar 17 initially move out of the spaces between the braking cams of the lower copy brake 15. After the upper end of the guide rail 34 has been reached, this is reported by a limit switch similar to the limit switch 33. Access to the cross-cutter components of the lower conveying plane is then provided.

We claim:

1. A device for diverting and removing copies from a conveyed stream thereof in a rotary cross cutter or delivery in a sheet-fed rotary printing press, comprising:

means for defining a copy-transport plane on which the copies are transported in a given transport direction;

a device for decelerating the copies which are transported at an incoming conveying speed, the decelerating device being disposed so as to act upon both sides of the copies which are to be decelerated;

a diverter and a copy guide cooperating with said diverter disposed downstream of the decelerating device as seen in the transport direction and above said copy-transport plane; and respective means defining two conveying planes disposed downstream of said copy guide as seen in the transport direction, at least one of said conveying plane-defining means including a slidably mounted and pneumatically acted-upon conveying device.

2. Device according to claim 1, wherein one of said conveying planes is disposed above the other and includes a delivery to which copies diverted from the conveyed stream are deliverable, the other of said conveying planes including a main pile to which the copies remaining in the conveyed stream are feedable.

3. Device according to claim 1, wherein one of said conveying planes is disposed above the other and includes press-on rollers operatively assigned thereto for transporting copies diverted from the conveyed stream.

4. Device according to claim 3, wherein said one conveying plane disposed above the other is formed of a floating bar having conveying functions, and including a delivery adjoining said floating bar.

5. Device according to claim 4, including a controlled air nozzle disposed above said delivery for applying air blasts to the copies so as to assist in pile formation in said delivery.

6. Device according to claim 1, wherein one of said conveying planes is disposed above the other, and an upper copy brake is accommodated in said one conveying plane.

7. Device according to claim 6, wherein said upper copy brake comprises braking cams provided with brushes.

8. Device according to claim 1, wherein one of said conveying planes is disposed above the other and is formed as a horizontal copy guide in a main operating region, and including a removal region for diverted copies adjoining said main operating region.

9. Device according to claim 1, wherein the conveying plane of said one conveying plane-defining means is lower than the other, and said pneumatically acted-upon conveying device is disengageable from said lower conveying plane-defining means.

10. Device according to claim 7, including a carriage to which said pneumatically acted-upon conveying device is attached.

11. Device according to claim 10, including a rail whereon said carriage is movable, and an actuating cylinder operatively engaging said carriage for moving said carriage on said rail.

12. Device according to claim 1, wherein said copy guide is formed of suction tapes having an entry region, and including swivel cams for deflecting the copies in said entry region of said suction tapes.

13. Device according to claim 1, wherein said copy guide is formed as a swivellable floating bar.

14. A device for diverting and removing copies from a conveyed stream thereof in a rotary cross cutter or delivery in a sheet-fed rotary printing press, comprising:

means for defining a copy-transport plane on which the copies are transported in a given transport direction; a device for decelerating the copies which are transported at an incoming conveying speed, the decelerating device being disposed so as to act upon both sides of the copies which are to be decelerated;

a diverter and a copy guide cooperating with said diverter disposed downstream of the decelerating device as seen in the transport direction and above said copy-transport plane;

respective means defining two conveying planes disposed downstream of said copy guide as seen in the transport direction, at least one of said conveying plane-defining means including a pneumatically acted-upon conveying device; and a carriage to which said pneumatically acted-upon conveying device is attached.

* * * * *